US005987286A

United States Patent [19]

Shin et al.

[11] Patent Number: 5,987,286

[45] Date of Patent: Nov. 16, 1999

[54] DEVICE FOR FEEDING TONER OF LASER BEAM PRINTER

[75] Inventors: Sang-Yob Shin; Cheol-Young Han; Hyong-Gu Lee, all of Kyungki-do, Rep. of Korea

[73] Assignee: SamSung Electronics Co., Ltd., Kyungki-do, Rep. of Korea

[21] Appl. No.: 08/966,538

[22] Filed: Nov. 10, 1997

[30] Foreign Application Priority Data

Nov. 8, 1996 [KR] Rep. of Korea ..... 96-52924

[51] Int. Cl.[6] ..... G03G 15/08

[52] U.S. Cl. ..... 399/258; 399/260; 399/263; 222/DIG. 1

[58] Field of Search ..... 399/258, 259, 399/260, 261, 262, 263, 106, 252, 253, 254; 222/DIG. 1

[56] References Cited

U.S. PATENT DOCUMENTS

| | | | |
|---|---|---|---|
| 4,194,830 | 3/1980 | Ohnuma et al. | 399/284 |
| 4,418,643 | 12/1983 | Barto, Jr. et al. | 399/261 |
| 4,548,490 | 10/1985 | Stirrat | 399/272 |
| 4,595,277 | 6/1986 | Maczuszenko et al. | 399/260 X |
| 5,016,560 | 5/1991 | Asada et al. | 399/281 |
| 5,128,722 | 7/1992 | Natsuhara et al. | 399/280 |
| 5,138,385 | 8/1992 | Toyoshi et al. | 399/88 |
| 5,172,168 | 12/1992 | Satoh et al. | 399/224 |
| 5,185,631 | 2/1993 | Shibata | 399/263 |
| 5,188,262 | 2/1993 | Fielding | 222/201 |
| 5,257,077 | 10/1993 | Peters, Jr. et al. | 399/263 |
| 5,345,298 | 9/1994 | Corrigan, Jr. | 399/260 |
| 5,557,382 | 9/1996 | Tatsumi et al. | 399/262 |

*Primary Examiner*—Arthur T. Grimley
*Assistant Examiner*—Hoan Tran
*Attorney, Agent, or Firm*—Robert E. Bushnell, Esq.

[57] ABSTRACT

A device for feeding toner of a laser beam printer includes a plurality of minute feeding holes formed in a toner hopper and supplying toner therethrough, an agitator installed in the toner hopper and rotated to stir the toner to be supplied through the feeding holes; and a toner disintegrating member shaken by the rotation of the agitator, supplying a limited amount of toner and giving a limited amount of the toner stained on a feeding roller.

10 Claims, 2 Drawing Sheets

DEVICE FOR FEEDING TONER OF LASER BEAM PRINTER

CLAIM OF PRIORITY

This application makes reference to, incorporates the same herein, and claims all benefits accruing under 35 U.S.C. § 119 from an application entitled Device for Feeding Toner of Laser Beam Printer earlier filed in the Korean Industrial Property Office on the 8th of November 1996, and there duly assigned Ser. No. 96-52924 by that Office, a copy of which application is annexed hereto.

BACKGROUND OF THE INVENTION

1. Field of the Invention

The present invention relates to a device for feeding toner of a laser beam printer and, more particularly, to a device for feeding toner which is designed to feed a limited amount of toner contained in a toner hopper of a laser beam printer into a developer for image development.

2. Related Art

In laser beam printers, toner feeding device is customarily used as part of a mono-component developer such as disclosed in U.S. Pat. Nos. 4,194,830 for Development Apparatus issued to Ohnuma et al., 5,016,560 for Device For Image Toner Distribution On A Developing Device issued to Asada et al., 5,128,722 for Developing Device Excellent In Toner Transportability issued to Natsuhara et al., and 5,138,385 for Developing Device With Electrically Floating Developing Roller issued to Toyoshi et al., for feeding toner to develop an electrostatic image formed on an image carrier such as a photosensitive drum. Mono-component developers which can be magnetic and non-magnetic are generally simpler and smaller in size and lower in cost, when compared with two-component developers. In principle, a developing roller is set between a photosensitive drum and a toner hopper. A feeding roller which supplies toner to the developing roller and a coating blade is pressed against the developing roller. Rotation of the feeding roller causes toner particles to be transferred to the developing roller so as to form a thin toner layer on the developing roller. As the developing roller is rotated, a single-component toner adheres to the surface of the developing roller by electronic charges between a coating blade and toner particles, and between the developing roller and the toner particles. Then, the toner particles, supported on the developing roller are caused to adhere electrostatically on a photosensitive drum to form an electrostatic latent image.

Contemporary toner hopper generally has a rectangular-shaped feeding opening of a predetermined width as described, for example, in U.S. Pat. Nos. 4,418,643 for Feed Hopper Assembly For Particulate Material And Printer issued to Barto, Jr. et al., 4,548,490 for Toner Feeder System issued to Stirrat et al., 4,594,277 for Toner Supply Control System issued to Maczuszenko et al., and 5,307,128 for Toner Supply Device issued to Murasaki et al., for supplying toner to the developing roller for image development. Such an extended opening of the toner hopper, however, causes a lump of toner around the feeding roller when a large amount of toner is introduced into the developer. When a lump of toner is introduced into the developer, the toner is difficult to agitate and is susceptible to leakage. As a result, the quality of image printing is deteriorated.

SUMMARY OF THE INVENTION

Accordingly, it is therefore an object of the present invention to provide a toner feeding device of a laser beam printer for efficiently regulating and feeding toner for image development.

It is also an object to provide a toner feeding device of a laser beam printer with a simplified structure for feeding an intended amount of toner for image development.

These and other objects of the present invention can be achieved by a device for feeding toner of a laser beam printer which includes a toner hopper having a plurality of minute feeding holes perforated on one side for supplying toner; an agitator installed in the toner hopper for rotation to stir the toner to be supplied for image development through the feeding holes; and atoner disintegrating member shaken by the rotation of the agitator, for supplying a limited amount of toner and giving an impact on the toner strained on a feeding roller.

The present invention is more specifically described in the following paragraphs by reference to the drawings attached only by way of example.

BRIEF DESCRIPTION OF THE ATTACHED DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENT

Figure 1:
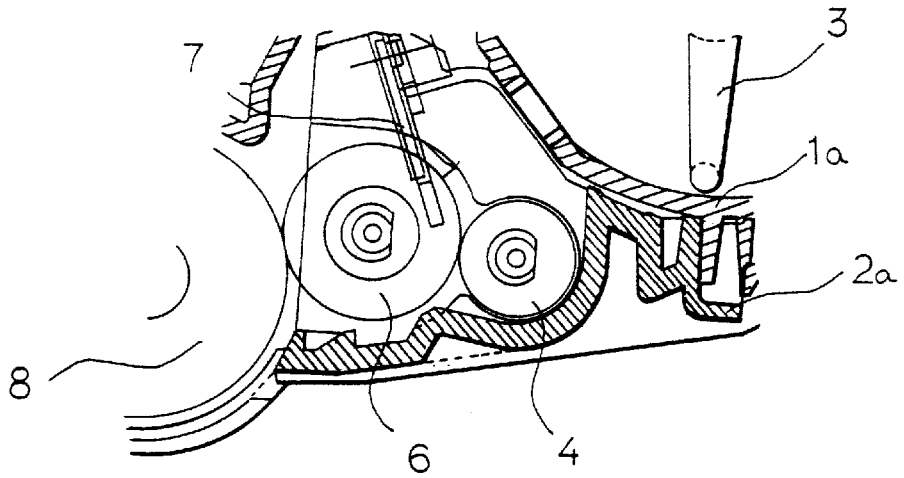
FIG. 1 is a vertical cross sectional view of an exemplary toner feeding device of a laser beam printer.

Referring now to the drawings and particularly to FIG. 1 which illustrates a typical toner feeding device of a laser beam printer which employs a non-magnetic and mono-component developer. As shown in FIG. 1, the toner feeding device has a developing roller 6 which is a rubber roller made of a conductive material, and a feeding roller 4 made of a conductive material to supply toner uniformly over the developing roller 6. A doctor blade 7 is installed to control the amount or toner is positioned on the developing roller 6 and covers the surface of the developing roller 6 with a limited amount and thickness of toner. Although similar to the conventional image transfer process in some aspects, this developing method is different from the transfer imaging process in that a limited amount of toner is charged to develop a latent image on a photosensitive drum 8.

After a charging device is used to charge the photosensitive drum 8 and a latent image is formed with an exposing device, the feeding roller 4 is rotated to transfer the toner onto the developing roller 6 by applying a feeding voltage to the feeding roller 4 and a developing voltage to the developing roller 6. Frictional electric field forms from the toner between the feeding roller 4 and developing roller 6, clearing the latent image of the toner previously fed on the developing roller 6 and applying toner to the developing roller 6 in order to form a toner layer of the same pattern as in the previous step.

As the toner moves on the developing roller 6 and passes through the blade 7, the toner on the developing roller 6 is charged and controlled to form a uniform toner layer so that the toner deposited on the developing roller 6 is stick to the latent image previously formed on the photosensitive drum 8. The toner on the photosensitive drum 8 is then transferred to a recording paper by a transfer device. The residual toner, or foreign material such as paper powder is adhered to the photosensitive drum 8 and removed by the action of the blade 7. The same will be repeated for a later continuous printing.

Figure 2:
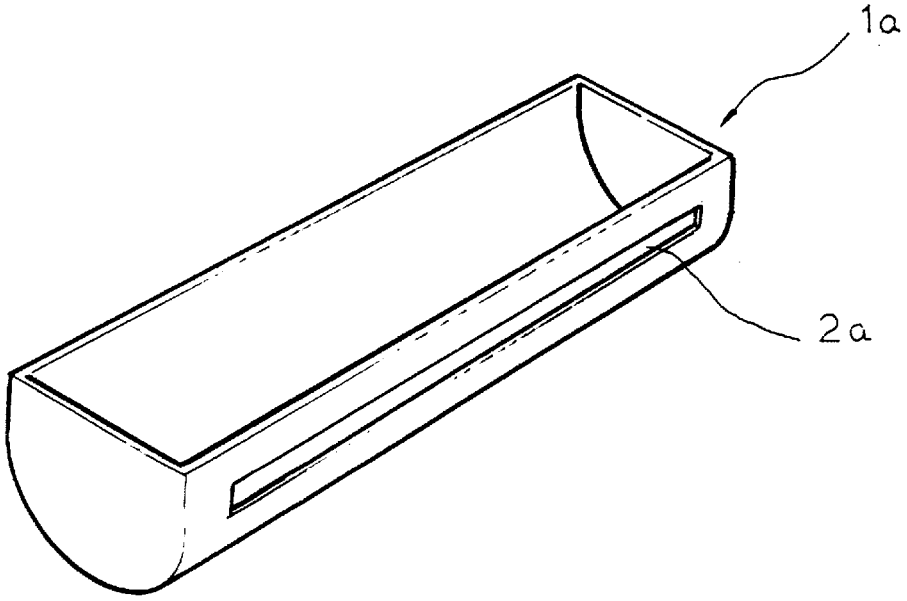
FIG. 2 is a perspective view of the toner hopper as shown in FIG. 1.

FIG. 2 illustrates a typical toner hopper for supplying toner for image development. As shown in FIG. 2, the toner hopper 1*a* has a rectangular-shaped feeding opening 2*a* in the slit form of a predetermined width in order to feed toner from the toner hopper la to the developing roller 6 for image development. Such an extended opening 2*a* of the toner hopper 1*a,* as I have observed however, causes a lump of toner around the feeding roller when a large amount of toner is introduced into the developer. When a lump of toner is introduced into the developer, the toner is difficult to agitate and is susceptible to leakage. As a result, the quality of image printing is deteriorated.

Figure 3:
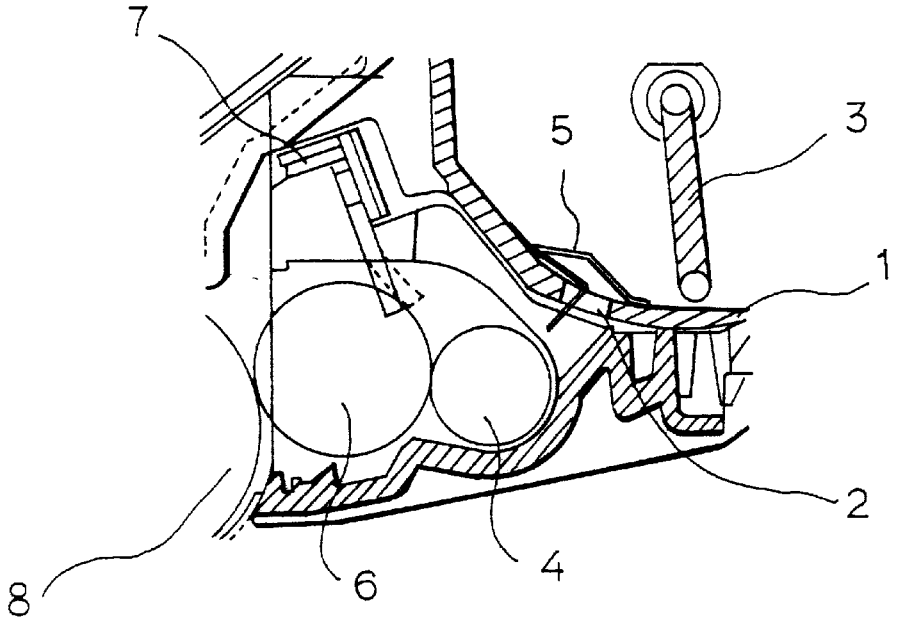
FIG. 3 is a vertical cross sectional view of a toner feeding device of a laser beam printer constructed according to the principles of the present invention.
Figure 4:
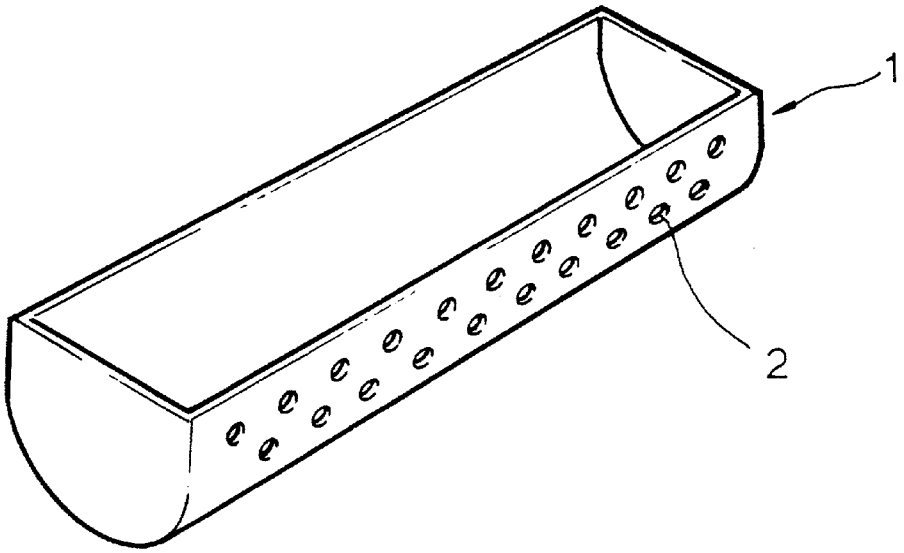
FIG. 4 is a perspective view of the toner hopper as shown in FIG. 3.

Turning now to FIG. 3 which illustrates a toner feeding device of a laser beam printer as constructed according to the principles of the present invention, and FIG. 4 which is a perspective of the toner hopper shown in FIG. 3. A plurality of minute feeding holes 2 of about 1 to 4 mm in diameter are formed at the bottom of a toner hopper 1 that contains toner. In the toner hopper 1 is positioned an agitator 3, which is rotated to agitate the toner hopper 1 and by this way feed a limited amount of toner through the minute feeding holes 2. At the bottom of the toner hopper 1 is installed a toner disintegration member 5 of about 0.05 to 0.2 mm thick so as to on impact on the toner stained on a feeding roller 4.

As shown in FIG. 3 and FIG. 4, as the agitator 3 installed in the toner hopper 1 is rotated to press the toner, a limited amount of toner is periodically fed through a plurality of feeding holes 2 of about 1 to 4 mm in diameter, which are formed at the bottom of the toner hopper 1. This prevents a large amount of toner from being fed into the developer from the toner hopper 1 through the feeding holes 2 at a time, and makes it possible to form uniform images on recording paper.

The agitator 3 is rotated to shake the toner disintegration member 5 which is installed in the toner hopper 1 and between 0.05 mm and 0.2 mm in thickness, agitate and feed a limited amount of toner through the feeding holes 2.

At the same time, the toner disintegrating member 5 provides an impact on the toner stained on the feeding roller 4 so that the aggregation of toner, causing unstable image formation, can be avoided even when the toner is not used for a long time, and the same effect of using new toner will be attained at any time. The toner disintegrating member 5 may be rigidly or freely installed in the toner hopper 1, or have special projections.

As described above, at the bottom of the toner hopper 1 is formed a plurality of minute feeding holes 2 and the toner disintegration member 5, so that a limited amount of toner can be applied into the developer through the feeding holes 2 where uniform images are formed. Even if the toner previously fed into the developing machine is not used for a long time, the laser disintegration member 5 can impact the toner stained on the feeding roller 4 by the rotation of the agitator 3 in order to attain the same effect of using new toner at any time and thereby enhancing the reliability of products.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A device for feeding toner of a laser beam printer, comprising:

a toner hopper having a body comprised of a plurality of minute feeding holes perforated at a bottom of said body for supplying toner via said feeding holes;

an agitator installed in the toner hopper for rotation to stir the toner to be supplied through said feeding holes; and a toner disintegration member installed inside the toner hopper and shaken by rotation of the agitator, for regulating a limited amount of toner supplied through said feeding holes to a feeding roller while providing an impact to the toner stained on the feeding roller for image development.

2. The device of claim 1, further comprised of each of the feeding holes formed at the bottom of the toner hopper exhibiting a diameter of approximately 1 mm to 4 mm.

3. The device of claim 1, further comprised of said toner disintegration member exhibiting a thickness of approximately 0.05 mm to 0.2 mm.

4. The device of claim 1, further comprised of said toner disintegration member being installed in the toner hopper rigidly or freely.

5. The device of claim 1, further comprised of said toner disintegration member having special projections.

6. A developer disposed adjacent to a photosensitive drum in a laser beam printer, comprising:

a toner hopper having a body comprised of a plurality of minute feeding holes perforated at a bottom of said body for serving as a toner supply outlet for supplying toner;

a developing roller disposed to develop an electrostatic latent image formed on said photosensitive drum;

a doctor blade disposed to regulate an amount of developer formed on a surface of said developing roller, said developer representing a mixture of toner and a carrier at a predetermined ratio;

a feeding roller arranged at said toner supply outlet of said toner hopper, for supplying said toner from said toner hopper to said developing roller;

an agitation member installed in said toner hopper for rotating and agitating said toner contained said toner hopper to feed said toner to said feeding roller via said feeding holes at said toner supply outlet; and a toner disintegration member installed inside said toner hopper and shaken by rotation of the agitation member, for supplying the limited amount of toner to said feeding roller via said feeding holes at said toner supply outlet while providing an impact to the toner stained on said feeding roller for image development.

7. The developer of claim 6, further comprised of each of the feeding holes formed at the bottom of the toner hopper exhibiting a diameter of approximately 1 mm to 4 mm.

8. The developer of claim 6, further comprised of said toner disintegration member exhibiting a thickness of approximately 0.05 mm to 0.2 mm.

9. The developer of claim 6, further comprised of said toner disintegration member being installed in the toner hopper rigidly or freely.

10. The developer of claim 6, further comprised of said toner disintegration member having special projections.

* * * * *